US008519618B2

(12) United States Patent
Shen

(10) Patent No.: US 8,519,618 B2
(45) Date of Patent: Aug. 27, 2013

(54) DISPLAY

(75) Inventor: Weng-Chang Shen, Taoyuan County (TW)

(73) Assignee: HTC Corporation, Taoyuan County (TW)

( * ) Notice: Subject to any disclaimer, the term of this patent is extended or adjusted under 35 U.S.C. 154(b) by 183 days.

(21) Appl. No.: 13/220,691

(22) Filed: Aug. 30, 2011

(65) Prior Publication Data

US 2013/0049642 A1 Feb. 28, 2013

(51) Int. Cl.
*H05B 33/00* (2006.01)
*H05B 37/02* (2006.01)

(52) U.S. Cl.
USPC ..... 313/505; 313/506; 315/169.4; 315/56; 315/334; 345/75

(58) Field of Classification Search
None
See application file for complete search history.

(56) References Cited

U.S. PATENT DOCUMENTS

| | | | | |
|---|---|---|---|---|
| 4,455,774 | A * | 6/1984 | Watanabe | 40/451 |
| 4,459,514 | A * | 7/1984 | Morimoto et al. | 315/169.1 |
| 5,448,133 | A * | 9/1995 | Ise | 313/497 |
| 5,939,833 | A * | 8/1999 | Song et al. | 315/169.1 |
| 7,156,715 | B2 * | 1/2007 | Lee et al. | 445/24 |
| 7,327,080 | B2 | 2/2008 | DiSanto et al. | |
| 2010/0134313 | A1 * | 6/2010 | Aoki et al. | 340/815.4 |
| 2012/0268445 | A1 * | 10/2012 | Ogata et al. | 345/212 |

* cited by examiner

*Primary Examiner* — Ashok Patel
(74) *Attorney, Agent, or Firm* — Jianq Chyun IP Office

(57) ABSTRACT

A display having a first substrate and a second substrate parallel to each other, a cathode layer, a plurality of electroluminescences, a plurality of anodes, and a driving circuit is provided. The first substrate has a first surface. The second substrate has a second surface and a third surface opposite to each other, and the second surface faces the first surface. At least one of the first and the second substrates is transparent. The cathode layer disposed at the first surface has a plurality of tips. The plural electroluminescences are disposed at the second surface, and an interval is formed between the plural electroluminescences and the cathode layer. The positions of the plural anodes are at the third surface and correspond to the positions of plural electroluminescences on the second substrate. The driving circuit is disposed at the third surface and electrically connected to the plural anodes.

17 Claims, 4 Drawing Sheets

DISPLAY

BACKGROUND OF THE INVENTION

1. Field of the Invention

The application relates to a display. Particularly, the application relates to an electroluminescent display.

2. Description of Related Art

Along with expansion of application fields and increase of contents of transmission information, display techniques are gradually diversified, and consumer's demands for the displays are also increased. From the primary monochrome of black and white, colourful to three-dimensional (3D) display in the future, and from cathode ray tubes (CRT), flat panel displays to portable, folding displays or even large screen displays, the displays are researched and developed to be more practical, which are widely used in people's daily life.

The commonly used displays in the market include liquid crystal displays (LCD) and organic light-emitting diode (OLED) displays, etc. Generally, the LCD uses a backlight module to provide a light source, so that it has a certain thickness, and reduction of the thickness thereof is limited. Although the OLED display does not require an extra backlight source, since brightness of a used organic material is reduced as time increases, a display quality thereof is decreased as time increases.

SUMMARY OF THE INVENTION

The application is directed to an electroluminescent display, which does not require an extra backlight source during display, so that it has a thin thickness. Moreover, in the application, since an inorganic material can be used as electroluminescences of the display, reduction of brightness of the electroluminescences along with time is avoided, so that a service life of the display is prolonged and display quality thereof is improved.

The application provides a display having a first substrate and a second substrate parallel to each other, a cathode layer, a plurality of electroluminescences, a plurality of anodes, and a driving circuit. The first substrate has a first surface. The second substrate has a second surface and a third surface opposite to each other, and the second surface faces the first surface. At least one of the first substrate and the second substrate is a transparent substrate. The cathode layer is disposed on the first surface, and a surface of the cathode layer has a plurality of tips. The electroluminescences are formed on the second surface, and an interval is formed between the electroluminescences and the cathode layer. The anodes are formed on the third surface, and the electroluminescences and the anodes are respectively disposed at corresponding positions at two sides of the second substrate. The driving circuit is disposed on the third surface, and is electrically connected to the anodes.

According to the above descriptions, in the display of the application, the driving circuit is used to control potentials of the anodes to induce the tips of the cathode layer to emit electrons, and the electrons impact the electroluminescences during a process of moving towards the anodes, and lights emitted from the electroluminescences pass through the first substrate or the second substrate to form a display image.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1A:
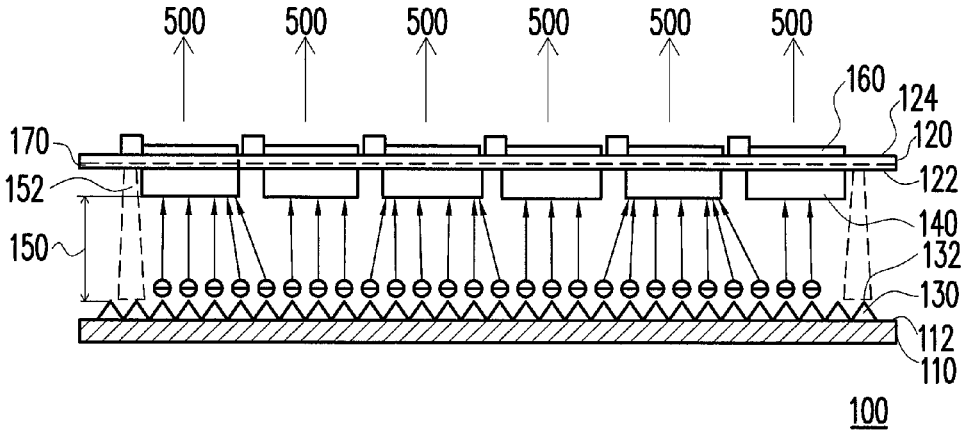
FIG. 1A is a schematic diagram of a display according to a first embodiment of the invention.
Figure 1B:
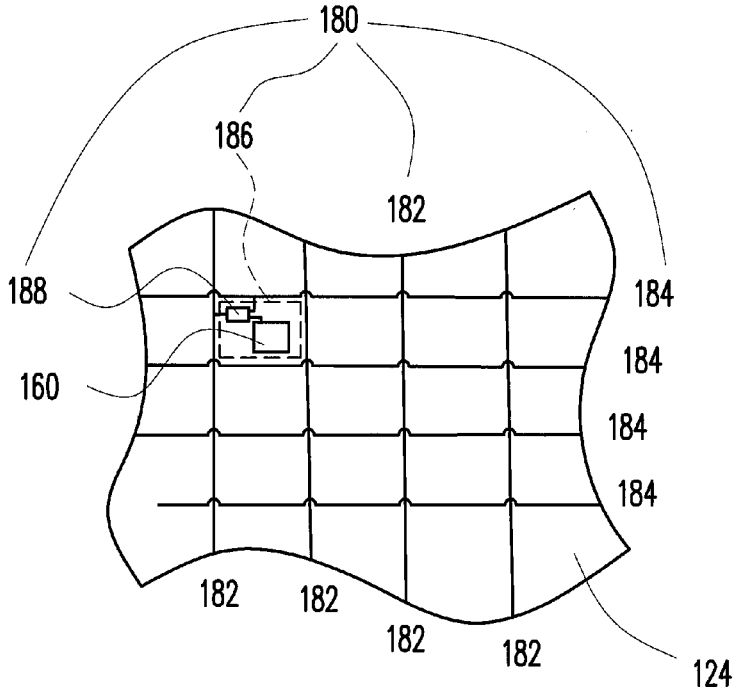
FIG. 1B is a partial schematic diagram of a third surface of the display of the first embodiment.

Referring to FIG. 1A and FIG. 1B, FIG. 1A is a schematic diagram of a display according to a first embodiment of the invention, and FIG. 1B is a partial schematic diagram of a third surface of the display of the first embodiment. The display 100 includes a first substrate 110, a second substrate 120, a cathode layer 130, a plurality of electroluminescences 140, a plurality of anodes 160, and a driving circuit 180.

The first substrate 110 has a first surface 112, and the second substrate 120 is parallel to the first substrate 110. The second substrate 120 has a second surface 122 and a third surface 124 opposite to each other, and the second surface 122 faces the first surface 112. At least one of the first substrate 110 and the second substrate 120 is a transparent substrate. In the present embodiment, only the second substrate 120 is the transparent substrate. The cathode layer 130 is disposed on the first surface 112 of the first substrate 110, and a surface of the cathode layer 130 has a plurality of tips 132. The electroluminescences 140 are formed on the second surface 122 of the second substrate 120, and an interval 150 is formed between the electroluminescences 140 and the cathode layer 130. The anodes 160 are formed on the third surface 124 of the second substrate 120, and the electroluminescences 140 and the anodes 160 are respectively disposed at corresponding positions at two sides of the second substrate 120. The driving circuit 180 is disposed on the third surface 124 of the second substrate 120, and is electrically connected to the anodes 160.

As shown in FIG. 1B, the driving circuit 180 and the anodes 160 are disposed on the third surface 124. The driving circuit 180 includes a plurality of scan lines 182, a plurality of data lines 184 and a plurality of active devices 188. On the third surface 124, the scan lines 182 are substantially parallel to each other, and the data lines 184 are substantially parallel to each other. Moreover, the scan lines 182 and the data lines 184 are intersected to each other to define a plurality of pixel regions 186 on the third surface 124.

The anodes 160 are respectively located in the pixel regions 186. The active devices 188 are disposed corresponding to the pixel regions 186, and are electrically connected to the anodes 160, respectively. Each of the scan lines 182 and each of the data lines 184 are electrically connected to the corresponding active device 188. The active devices 188 are respectively disposed in the pixel regions 186 as that shown in FIG. 4. Certainly, the active devices 188 can also be disposed at intersections of the scan lines 182 and the data lines 184 or other positions. The positions of the active devices 188 are not limited by the layout of FIG. 4.

In the present embodiment, the active devices 188 are thin-film transistors. Regarding an actuation method of the driving circuit 180, high level or low level signals are inputted at different time sequence through the scan lines 182, so that the thin-film transistors are correspondingly turned on/off. When the thin-film transistors are turned on, a plurality of signals are respectively input to the anodes 160 through the data lines 184 for providing a positive potential required by each of the anodes 160. It should be noticed that in the following embodiments, an actuation method of a driving circuit can be the same to that of the driving circuit of the present embodiment, so that details descriptions of the driving circuit are not repeated in the following embodiments.

In the display of the application, the driving circuit 180 is used to control the potentials of the anodes 160, and electrons attracted by the anodes 160 depart from the cathode layer 130 to move towards the anodes 160. Since the electroluminescences 140 are located in a moving path of the electrons, the electrons may directly impact the electroluminescences 140, and the electroluminescences 140 can emit light based on an electroluminescence principle. Moreover, in the display of the application, by adjusting a magnitude of the positive potential of the anodes 160, the number of the electrons departed from the cathode layer 130 is controlled, so as to adjust a light emitting brightness. In the present embodiment, the electroluminescences 140 comprise fluorescent materials or phosphorescent materials, and emit lights of different colors, for example three primary colors of R, G and B, to form a display image. Particularly, the electroluminescences 140 may comprise an inorganic material, so that a characteristic and brightness thereof are not decayed as time increases.

Moreover, in the present embodiment, a material of the anode 160 includes a transparent conductive material, where the transparent conductive material includes indium tin oxide (ITO), indium zinc oxide (IZO) or indium gallium zinc oxide (IGZO), etc. In the present embodiment, since the second substrate 120 and the anodes 160 are transparent, the lights 500 emitted from the electroluminescences 140 can penetrate through the second substrate 120 to form the display image on the second substrate 120.

Moreover, the display 100 further includes a spacer 152. The spacer 152 is disposed between the first substrate 110 and the second substrate 120 to maintain the interval 150. A purpose of maintaining the interval 150 is to accelerate the electrons to a suitable speed to impact the electroluminescences 140 when the electrons are attracted by the anodes 160. In FIG. 1, the spacer 152 leans against the second substrate 120 and the cathode layer 130, though a method of allocating the spacer 152 and a position thereof are not limited. Moreover, a ground layer 170 is disposed on the second surface 122 of the second substrate 120 to avoid accumulating the electrons on the second substrate 120.

Figure 2:
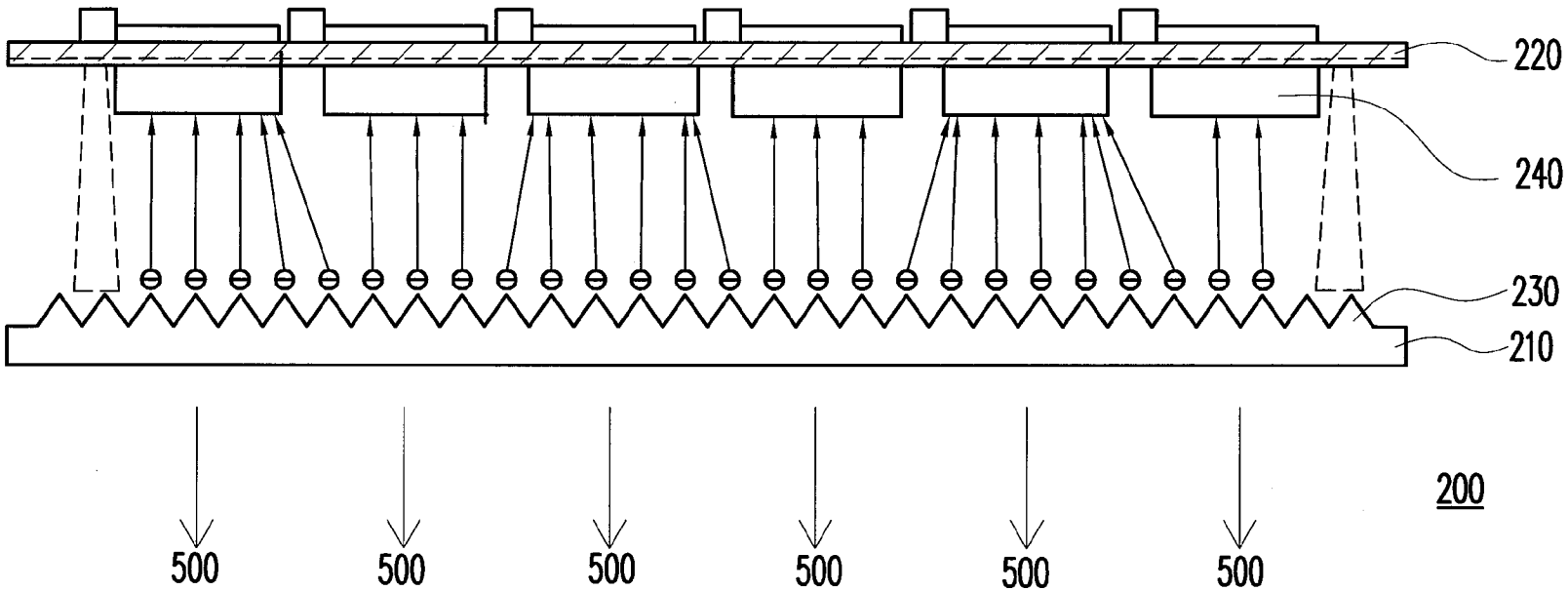
FIG. 2 is a schematic diagram of a display according to a second embodiment of the invention.

FIG. 2 is a schematic diagram of a display according to a second embodiment of the invention. In the display 200 of the second embodiment, only a first substrate 210 is a transparent substrate. Moreover, a material of the cathode layer 230 includes a transparent conductive material, where the transparent conductive material includes ITO, IZO or IGZO, etc., though the invention is not limited thereto. Namely, compared to the first embodiment that the lights 500 penetrate through the second substrate 120, in the present embodiment, the lights 500 emitted by electroluminescences 240 penetrate through the first substrate 210 to form a display image.

Figure 3:
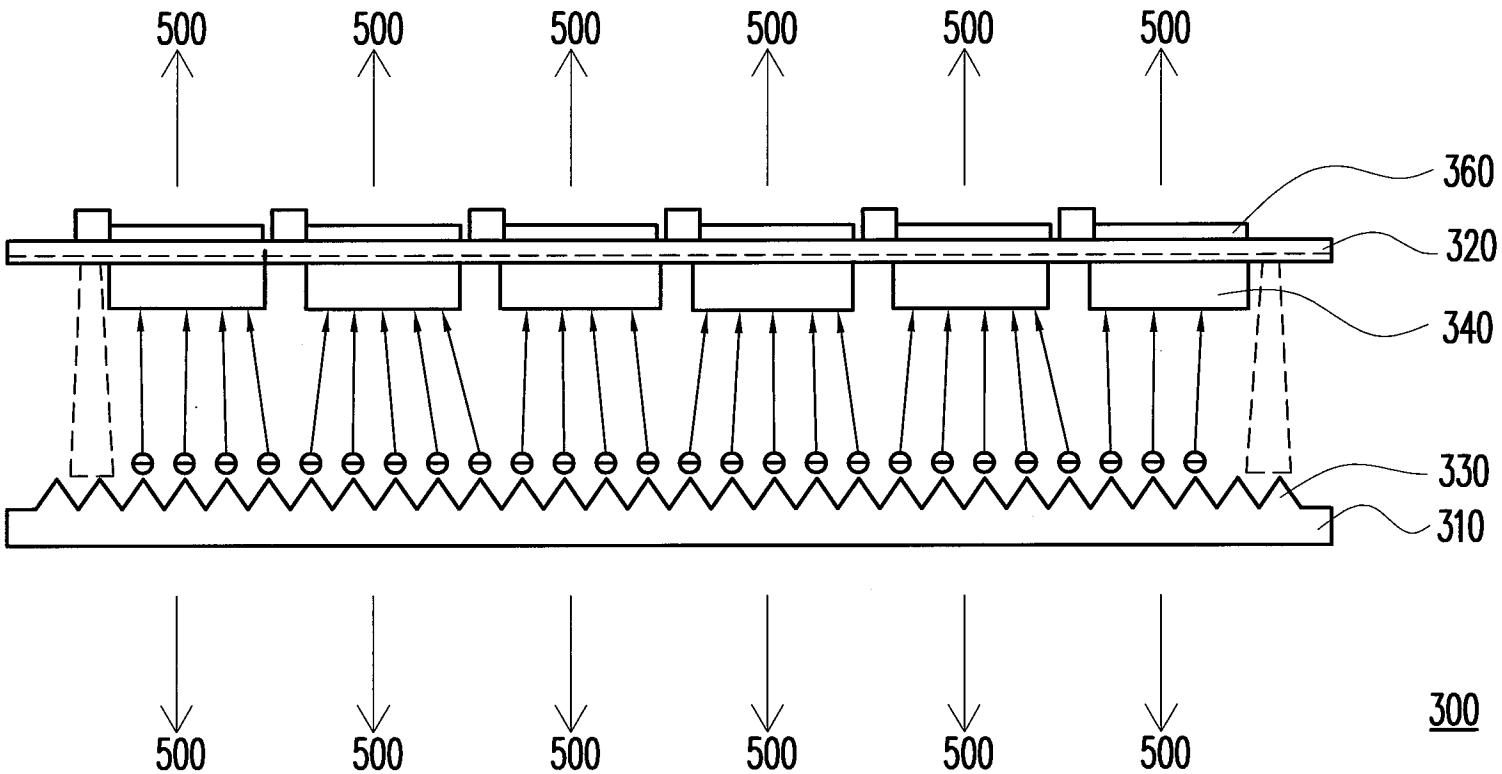
FIG. 3 is a schematic diagram of a display according to a third embodiment of the invention.

FIG. 3 is a schematic diagram of a display according to a third embodiment of the invention. In the third embodiment, a first substrate 310 and a second substrate 320 are transparent substrates, and materials of anodes 360 and a cathode layer 330 include a transparent conductive material, where the transparent conductive material includes ITO, IZO or IGZO, etc., though the invention is not limited thereto. In the present embodiment, the lights 500 emitted by electroluminescences 340 can penetrate through the first substrate 310 and the second substrate 320, so that both sides of the display 300 can display images.

Figure 4:
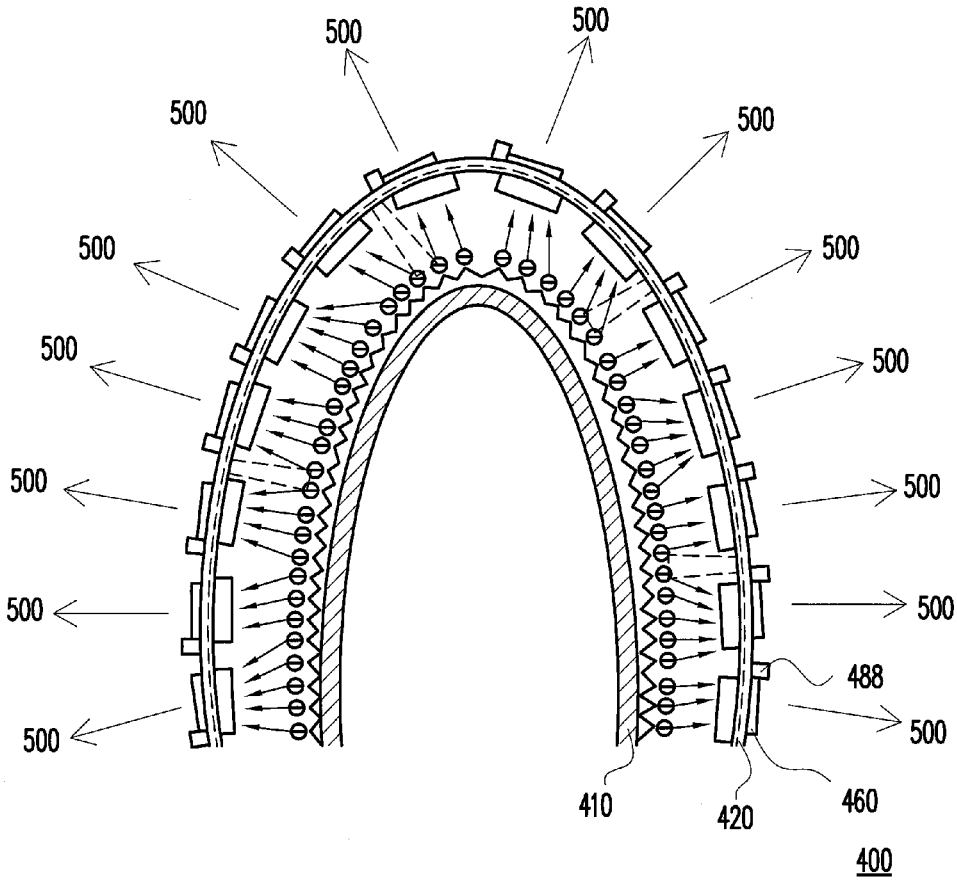
FIG. 4 is a schematic diagram of a display according to a fourth embodiment of the invention.

FIG. 4 is a schematic diagram of a display according to a fourth embodiment of the invention. In the fourth embodiment, a first substrate 410 and a second substrate 420 are flexible substrates, and active devices 488 are organic thin-film transistors. Since the organic thin-film transistors are flexible, the display 400 can be bended while displaying images as that shown in FIG. 4. In FIG. 4, the second substrate 420 is a transparent substrate, and a material of anodes 460 includes a transparent conductive material, where the transparent conductive material includes ITO, IZO or IGZO, etc., though the invention is not limited thereto. It should be noticed that although the lights 500 of FIG. 4 only penetrate through the second substrate 420, a situation that only the first substrate 410 is the transparent substrate is also applicable. Alternatively, the first substrate 410 and the second substrate 420 can be transparent substrates. The present embodiment mainly focuses on the flexibility of the display, and whether the image is displayed on the first substrate 410, the second substrate 420 or displayed on both of the first substrate 410 and the second substrate 420 is not limited.

In summary, in the display of the application, the driving circuit is used to control potentials of the anodes to induce the tips of the cathode layer to emit electrons with variable quantity to impact the electroluminescences, and lights emitted from the electroluminescences pass through the first substrate or the second substrate to form a display image. The display of the application does not require an extra backlight source during display, so that it has a thin thickness. Moreover, in the application, since an inorganic material can be used as the electroluminescences of the display, reduction of brightness of the electroluminescence along with time is avoided, so that a service life of the display is prolonged and display quality thereof is improved.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. A display, comprising:

a first substrate, having a first surface;

a second substrate, parallel to the first substrate, and having a second surface and a third surface opposite to each other, wherein the second surface faces the first surface, and at least one of the first substrate and the second substrate is a transparent substrate;

a cathode layer, disposed on the first surface, wherein a surface of the cathode layer has a plurality of tips;

a plurality of electroluminescences, formed on the second surface of the second substrate, wherein an interval is formed between the electroluminescences and the cathode layer;

a plurality of anodes, formed on the third surface of the second substrate, wherein the electroluminescences and the anodes are respectively disposed at corresponding positions at two sides of the second substrate; and a driving circuit, disposed on the third surface of the second substrate, and electrically connected to the anodes.

2. The display as claimed in claim 1, wherein the second substrate is a transparent substrate.

3. The display as claimed in claim 2, wherein a material of the anodes comprises a transparent conductive material.

4. The display as claimed in claim 1, wherein the first substrate is a transparent substrate.

5. The display as claimed in claim 4, wherein a material of the cathode layer comprises a transparent conductive material.

6. The display as claimed in claim 1, wherein the first substrate and the second substrate are transparent substrates.

7. The display as claimed in claim 6, wherein materials of the anodes and the cathode layer comprise a transparent conductive material.

8. The display as claimed in claim 3, wherein the transparent conductive material comprises indium tin oxide (ITO), indium zinc oxide (IZO) or indium gallium zinc oxide (IGZO).

9. The display as claimed in claim 1, further comprising a spacer disposed between the first substrate and the second substrate to maintain the interval.

10. The display as claimed in claim 1, wherein the electroluminescences comprise fluorescent materials or phosphorescent materials.

11. The display as claimed in claim 1, further comprising a ground layer disposed on the second surface of the second substrate.

12. The display as claimed in claim 1, wherein the driving circuit comprises:

a plurality of scan lines, disposed on the third surface of the second substrate, wherein the scan lines are substantially parallel to each other;

a plurality of data lines, disposed on the third surface of the second substrate, wherein the data lines are substantially parallel to each other, the scan lines and the data lines are intersected to define a plurality of pixel regions on the third surface, and the anode are respectively located in the pixel regions; and a plurality of active devices, disposed corresponding to the pixel regions, and electrically connected to the anodes respectively, wherein each of the scan lines and each of the data lines are electrically connected to the corresponding active device.

13. The display as claimed in claim 12, wherein the active device is an organic thin-film transistor.

14. The display as claimed in claim 13, wherein the first substrate or the second substrate is a flexible substrate.

15. The display as claimed in claim 1, wherein the electroluminescence comprises an inorganic material.

16. The display as claimed in claim 5, wherein the transparent conductive material comprises indium tin oxide (ITO), indium zinc oxide (IZO) or indium gallium zinc oxide (IGZO).

17. The display as claimed in claim 7, wherein the transparent conductive material comprises indium tin oxide (ITO), indium zinc oxide (IZO) or indium gallium zinc oxide (IGZO).

* * * * *